US009457817B2

(12) United States Patent
Smith

(10) Patent No.: US 9,457,817 B2
(45) Date of Patent: Oct. 4, 2016

(54) RAILCAR SHOVE LIGHT

(71) Applicant: Terry D. Smith, Wichita, KS (US)

(72) Inventor: Terry D. Smith, Wichita, KS (US)

( * ) Notice: Subject to any disclaimer, the term of this patent is extended or adjusted under 35 U.S.C. 154(b) by 0 days.

(21) Appl. No.: 14/285,146

(22) Filed: May 22, 2014

(65) Prior Publication Data

US 2014/0254185 A1 Sep. 11, 2014

(51) Int. Cl.
*B60Q 1/00* (2006.01)
*B61G 7/00* (2006.01)

(52) U.S. Cl.
CPC ..... *B61G 7/00* (2013.01)

(58) Field of Classification Search
CPC ..... B60Q 1/22; B61D 43/00; F21L 13/02; F21V 29/02
USPC ..... 362/478, 534, 543, 185, 192, 253, 459; 246/473 R; 290/52, 44, 54, 55
See application file for complete search history.

(56) References Cited

U.S. PATENT DOCUMENTS 396,241 A * 1/1889 Shawhan ..... B60Q 1/50 314/136
1,528,754 A * 3/1925 Bresson ..... F21L 13/02 290/52
4,592,217 A * 6/1986 Fernandez et al. ..... 73/129
4,654,629 A * 3/1987 Bezos et al. ..... 246/473.3
2012/0306218 A1* 12/2012 Bodnar et al. ..... 290/40 B

FOREIGN PATENT DOCUMENTS

CN 1971132 A * 5/2007

OTHER PUBLICATIONS

Railroad Tools and Solutions, LLC; "End of Train Lights"; Item Title: Online Catalog; Date: Sep. 11, 2014; Relevant pp. 5; Volume-issue number: N.A.; Publisher: Railroad Tools and Solutions, L.L.C.; City of Publication: Hillsboro, Ohio; Country of Publication: U.S.

* cited by examiner

*Primary Examiner* — Jason Moon Han
*Assistant Examiner* — Omar Rojas Cadima
(74) *Attorney, Agent, or Firm* — Kenneth H. Jack; Davis & Jack, L.L.C.

(57) ABSTRACT

A railcar shove light for attachment to a railcar rear coupler, the railcar shove light incorporating a turbine; a turbine case having a compressed air input port and an air output port, the turbine being rotatably mounted within the turbine case; an electrical alternator; a rotary drive linkage interconnecting the turbine and the electrical alternator; an array of electrical light emitters; electrical wires interconnecting the electrical light emitters and the electrical alternator; a light case housing the turbine, the turbine case, the alternator, the drive linkage, and the light emitter; and incorporating a brake line connectable air conduit for supplying and driving the turbine; the light case being mounted to a support post having lower end coupler engaging pin.

10 Claims, 3 Drawing Sheets

RAILCAR SHOVE LIGHT

FILED PROVISIONAL PATENT APPLICATION

This non-provisional patent application claims the benefit of and priority from U.S. provisional patent application No. 61/827,426 filed May 24, 2013. The inventor and applicant disclosed in said provisional application is the same person as the person who is disclosed as the inventor in and applicant of the instant application. The applicant asserts that structures and functions of structures disclosed and described in the instant application are in numerous respects identical to those described in said provisional application. For purposes of determining priority of claims whose subject matter constitutes new matter, the instant application should be treated as a continuation in part application.

FIELD OF THE INVENTION

This invention relates to railcars used and operated in the railway industry. More particularly, this invention relates to apparatus for enhancing safety and collision avoidance in backing of railcars during hours of darkness.

BACKGROUND OF THE INVENTION

Backing or shoving of railcars during darkness or nighttime hours presents and gives rise to significant hazards and dangers resulting from combined effects of low rearward visibility and a lengthened stopping distance. A freight train being backed at a near walking speed of 5 mph is typically capable of stopping within a distance between 90 feet and 125 feet. During hours of darkness, especially on moonless nights, a massive track obstructing object such as a stationary railcar, a passenger vehicle, or a truck located as close as 75 feet behind the backing train may not be visible to a lookout operator stationed at the rear of the train. In such circumstances, the lookout may be incapable of signaling for commencement of braking prior to the train's passage of a stopping distance boundary defined in front of the obstruction. In such circumstances, a destructive and potentially life threatening collision is often unavoidable.

A commonly known method for avoiding such collisions provides such lookout operator at the rear of a train with a battery powered electrical torch or flashlight. Such method typically undesirably occupies one of the operator's hands with the flashlight, giving rise to a risk of falling. Such method further undesirably results in intermittent and inaccurate rearward pointing of the electric flashlight. Such known method also continuously threatens the interruption of needed rearward illumination. In the event of an unexpected battery failure or dissipation of charge, rearward illumination ceases, and the risks of a train backing collision are undesirably increased.

The instant inventive railcar shove light solves or ameliorates the problems, defects, and deficiencies set forth above by providing a specially adapted railcar shove light apparatus which is capable of producing consistent, accurate, and hands free rearward illumination while eliminating any need for or reliance upon provided charged batteries.

BRIEF SUMMARY OF THE INVENTION

A first structural component of the railcar shove light comprises a radially vaned or radially finned turbine of a type which is capable of being efficiently driven by a supply of compressed air. The turbine component is preferably compact and suitably powered by railcar couplings within railcar air brake line air pressure.

A further structural component of the instant invention comprises a first case having at least a first, and preferably a radially opposed pair, of air input ports, and having at least a first air output port. In the preferred embodiment, the air turbine component is rotatably mounted within the first case, and such case's air input ports are positioned for rotatably driving the turbine by directing compressed brake line air over and against the turbine's blades.

A further structural component or sub-assembly of the instant inventive railcar shove light comprises an electrical alternator and rotary drive linkage combination wherein the rotary drive linkage operatively interconnects the turbine and the alternator. In a preferred embodiment, the provided electrical alternator produces a three phase alternating current output. Also, in the preferred embodiment, the alternator component includes an alternator housing or case which is directly mounted upon or is integrally or wholly formed with the turbine's case.

Further structural components of the instant invention comprise electrical illuminating means which are capable of being powered by the electrical alternator component. In the preferred embodiment, the electrical illuminating means comprise an array of or matrix of light emitting diodes. The electrical illuminating means may suitably alternatively comprise conventional incandescent bulbs, florescent bulbs, or halogen bulbs.

Further structural components of the instant inventive railcar shove light comprise a network of electrically conductive wires which operatively interconnect the electrical illuminating means and alternator components. In a preferred embodiment, the network of electrically conductive wires incorporates a three phase silicone based semi-conductor switched rectifier which rectifies or transfer to direct current the three phase output of the preferred alternator.

A further structural component of the instant inventive railcar shove light comprises a second larger case having a rearward end, such second case housing the electrical alternator, the drive linkage, the electrical illuminating means, and the electrically conductive wire components of the invention. Mounting means are preferably associated with the second case for internally supporting the electrical illuminating means for rearwardly directing light therefrom.

Further structural components of the instant invention comprise a communicating series of air conduits, lines, or hoses, along with coupling components, such series serving as a single conduit which communicates compressed air from a railcar's air brake line to the shove light's turbine.

Further structural components of the instant invention comprise a support post for upwardly holding and supporting the second case along with its contained components, such post preferably having positioning flange and pin mount structures presented at its lower end. In the preferred embodiment, the positioning flange and pin mount are respectively fitted and positioned for engaging an outer coupler jaw surface for rearwardly directing illumination and for nestingly engaging a flag post socket of the type commonly present upon a railcar coupler's jaw.

In use of the instant inventive railcar shove light, a lookout operator stationed at the rearmost car of a train being backed through darkness may initially mount the invention's lower pin mount within an upwardly opening flag post socket of such car's rear coupler. Thereafter, such operator may interconnect and securely couple the invention's compressed air conduit with the railcar's compressed air brake line. Upon such interconnection, and upon opening of line valves, the invention's illuminating means reliably actuates via the rotary operation of the air driven turbine and the alternator, and via the alternator's resultant supply of electricity to the preferred light emitting diodes. Intensely illuminated and hands free rearward illumination advantageously immediately results, such illumination lessening risks of falls, eliminating any risk of battery induced lighting failures, and lessening risks of rearward collisions during hours of darkness.

Accordingly, objects of the instant invention include the provision of a railcar shove light which incorporates structures, as described above, and which arranges those structures in relation to each other in manners described above, for the achievement of the objects and benefits described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
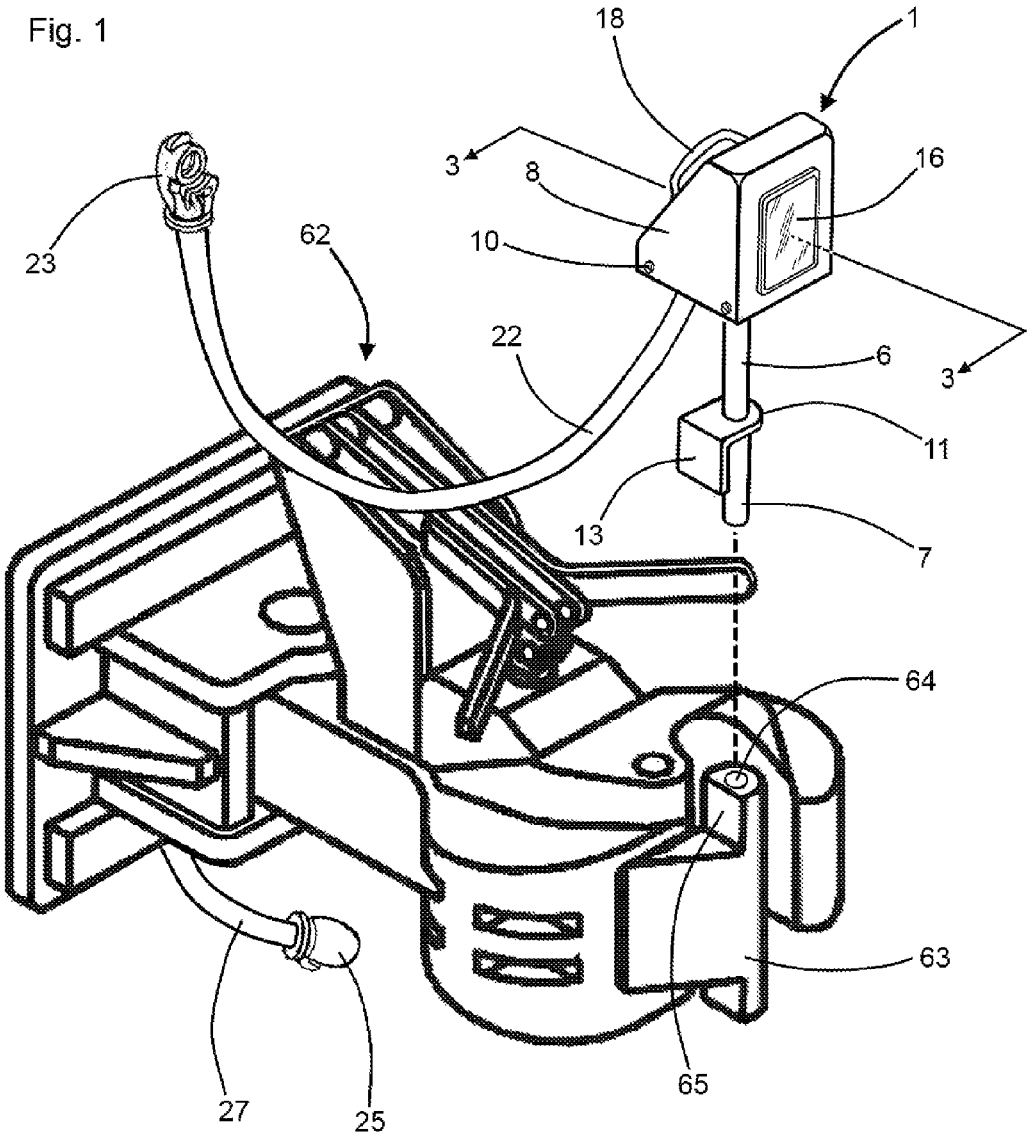
FIG. 1 includes a perspective view of the instant inventive railcar shove light, the view showing the shove light in an exploded orientation with respect to a railcar's rear coupler.
Figure 2:
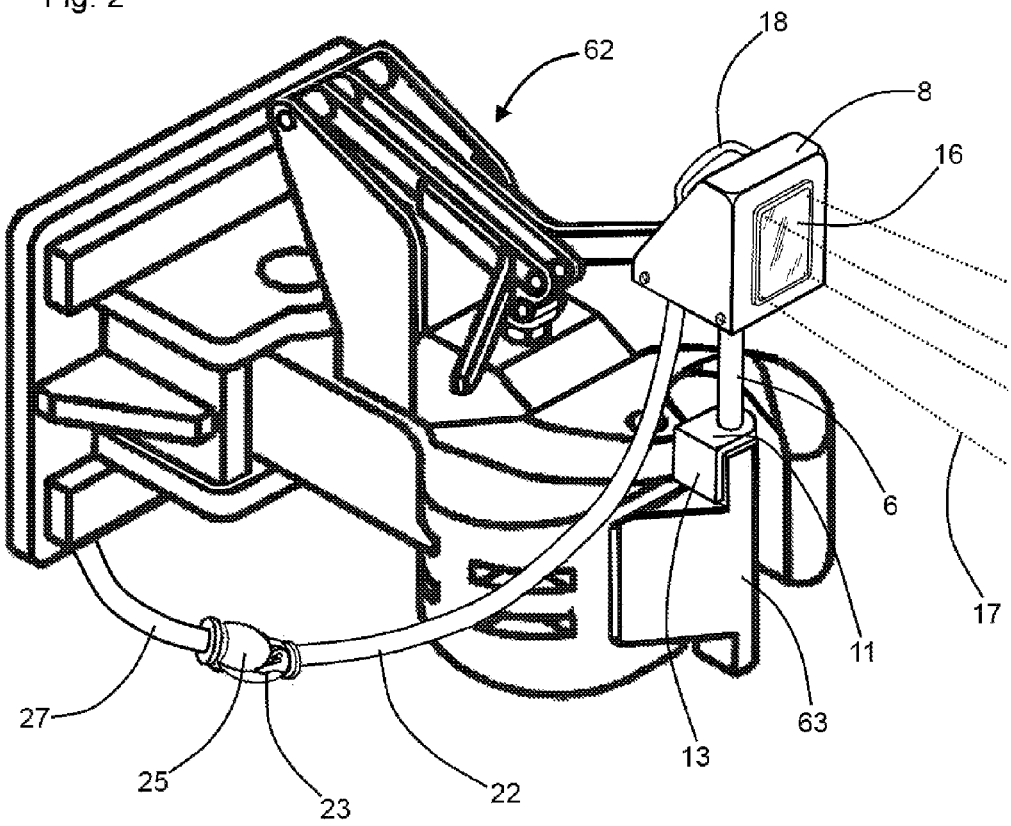
FIG. 2 redepicts the structures depicted in FIG. 1, the view of FIG. 2 alternatively showing the shove light interconnected with the railcar coupler and showing a compressed air brake line interconnection.
Figure 3:
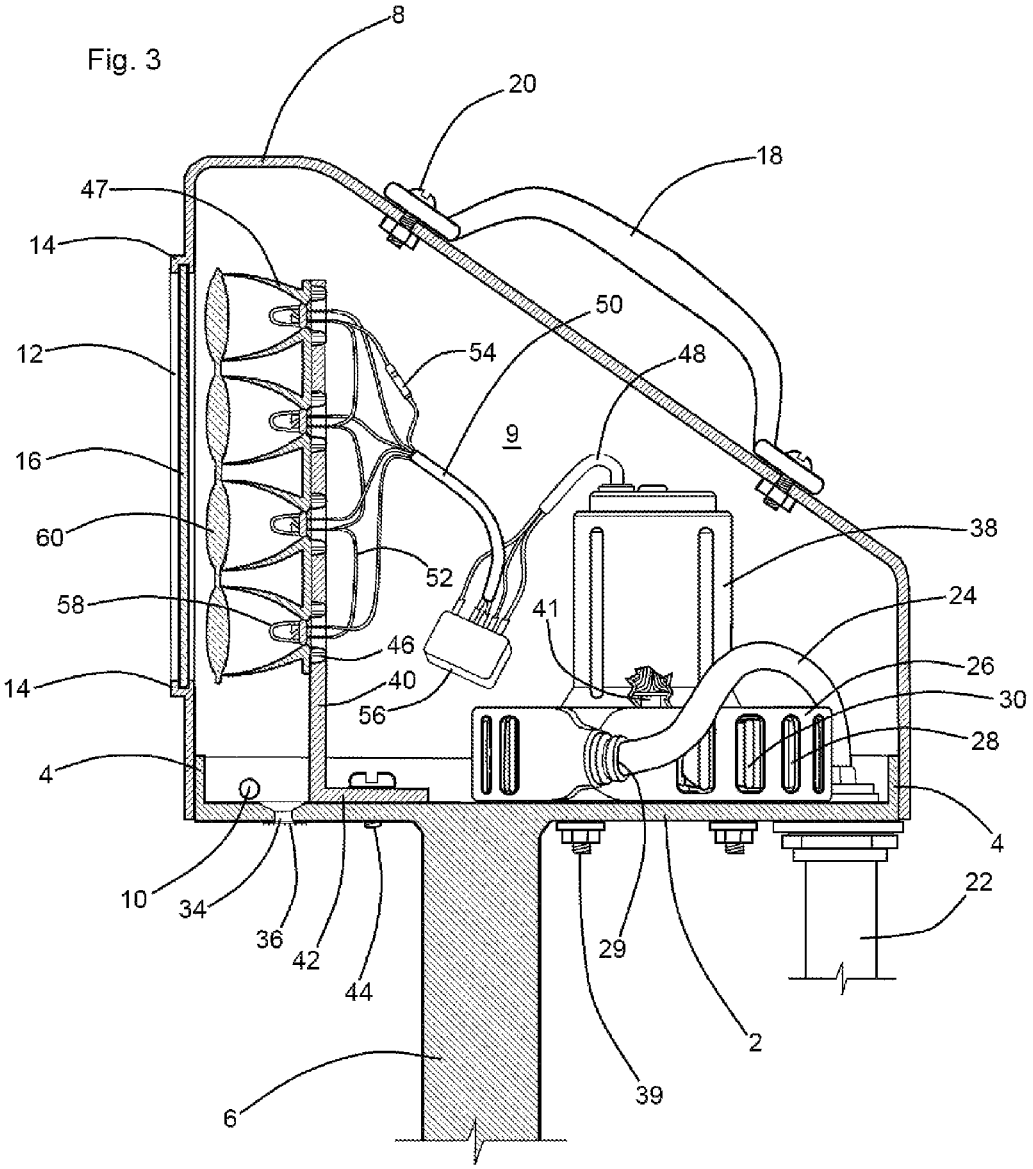
FIG. 3 is a partial sectional view as indicated in FIG. 1.

Referring now to the drawings, and in particular to Drawing FIG. 1, the instant inventive railcar shove light is referred to generally by Reference Arrow 1. The railcar shove light 1 is intended to be utilized as an auxiliary component upon a rear coupling assembly 62 of a railcar (not shown within views). Such coupling assembly 62 typically incorporates or has a closely associated compressed air brake line 27 and line coupling half 25. Such coupler 62 typically further incorporates a pivoting coupler jaw 63 which presents an upwardly opening flag post socket 64 and at least a first lateral land 65.

Referring simultaneously to all figures, the railcar shove light 1 preferably comprises a rotary air turbine 30 of the type capable of being rapidly driven or spun via compressed air power supplied by a train's brake line 27.

A further structural component of the inventive shove light comprises a turbine case or first case 26, such case preferably being cylindrically configured for housing and facilitating motion of turbine 30 which is rotatably mounted therein. In the preferred embodiment, the turbine case 26 has a plurality of air output ports 28 for emission of turbine driving air following impingement with the radially arrayed vanes or blades of turbine 30. In the preferred embodiment, the turbine case 26 includes at least a first compressed air input port 29 which communicates with an input conduit or hose segment 24 for supply of turbine driving compressed air.

A further structural component of the instant inventive railcar shove light preferably comprises an electrical alternator 38 and rotary drive linkage 41 combination, such combination's drive linkage 41 being viewable through a drawn "cut-away" section within the alternator housing. The rotary drive linkage 41 preferably operatively interconnects the alternator's rotating element with the turbine 30. In the preferred embodiment, the electrical alternator 38 is three phase, and such alternator's case is preferably fixedly attached to or formed wholly with the upper wall of turbine case 26.

Further structural components of the instant inventive railcar shove light comprise electrical illuminating means which preferably comprise an array of light emitting diodes 58. Such means may suitably alternatively comprise other commonly known electrically powered illuminators.

A network of electrically conductive wires 48,50,52 operatively interconnects the alternator 38 and the light emitting diodes 58, and in the preferred embodiment such network incorporates a rectifier 56 which performs electrical rectification upon the three phase electrical output of the alternator 38 to produce a positive direct current power supply. The light emitting diodes 58 are thereby electrically powered, and the network preferably includes a resistor 54 which is electrically common with the LEDs' negative terminals.

A further structural component of the instant inventive railcar shove light comprises a second or outer case 8 which is sized and adapted for securely and protectively housing the turbine, turbine case, alternator, light emitting diodes, and associated electrical components. In the preferred embodiment, the case 8 forms and defines a substantially hermetically sealed interior space 9 over a lower floor or foundation case component 2. In the preferred embodiment, the floor or foundation 2 presents a lateral or peripheral flange 4 which is closely fitted for upward insertion into and nesting receipt within a lower opening formed and defined by the case's side walls. Mounting screws 10 firmly and securely mount upper components of the case 8 to the floor 2. Mounting bolt and nut combinations 39 similarly securely mount the turbine 26,30 and alternator 38 components to the floor 2.

A further structural component of the instant inventive railcar shove light 1 comprises an air conduit or hose including a series connected combination of the railcar's air brake line 27, the railcar's air brake line coupler half 25, a matching coupler half 23 attached to air line 22, and an interior case mounted air hose 24 which communicates the output of air line 22 to the air input 29 of the turbine case 26. Upon connection of coupler halves 23 and 25 (and opening of air valves, as applicable), compressed air within brake line 27 communicates with turbine 30 for continuously providing rotary power to alternator 38.

A downwardly extending support post 6 is provided, such post's upper end preferably being fixedly attached to or formed wholly with the floor 2. The lower end of the post 6 preferably forms a pin component or half of a closely fitted pin and socket joint. The socket half of such joint preferably comprises a flag post socket 64, such socket commonly being present at an upper surface of a train coupler jaw. A lateral flange 13 and insertion stop 11 are fixedly attached to post 6 and are preferably positioned, sized, and oriented for an abutting and overlapping engagement with coupler jaw land 65. The engagement of flange 13 against land 65 advantageously assures that light 17 cast from the shove light 1 is consistently and accurately directed rearwardly along the tracks as the train backs.

In the preferred embodiment, the illuminating means comprise a matrix or array of parabolic reflectors 47, each reflector being positioned about one of the light emitting diodes 58, and further comprise a light port 12,14 which peripherally supports a hermetically sealed transparent sheet or window 16. To increase the effective distance that light 17 is cast rearwardly from the train, the illuminating means preferably further comprise an array of light focusing lenses 60 which are positioned between transparent sheet 16 and the reflectors 48.

Mounting means, preferably in the form of an "L" bracket 40 having a lower flange 42 are preferably provided for support of the light emitting diodes 58, the reflectors 47, and the lenses 60. Such mount is preferably attached to the floor 2 by screws 44. Heat sync elements 46 are operatively positioned adjacent the light emitting diodes 58, such heat syncs comprising preferred illuminating means components.

In a preferred embodiment of the instant inventive railcar shove light, a second air output port 34 preferably opens the interior space 9 at the floor 2 of the second case 8, such port permitting outward emissions of the brake line air following turbine driving service. Such air output port 34 facilitates air flow within case 8 and space 9 which dries internal electrical components and maintains a relatively positive interior case pressure which advantageously excludes inward flows of moisture. A screen 36 preferably covers port 34, such screen serving as an insect and foreign debris barrier.

For ease of handling and portability, a handle 18 is preferably fixedly attached to the ceiling of case 8 by means of mounting nuts and bolts 20.

In use of the instant inventive railcar shove light 1, an operator who performs a collision avoiding lookout function may securely sit or stand upon a rearmost railcar while the train backs through darkness. During such train backing, the operator may continuously dedicate both of his or her hands to personal stabilization and prevention of a fall from the train. During the performance of such lookout function, the nesting engagement of pin 7 within socket 64 combined with the abutting engagement of flange 13 with coupler jaw land 65 performs a "hands free" light directing function wherein light 17 which emits from case 8 through transparent sheet 16 is continuously and properly cast rearwardly along the tracks. Simultaneously with the instant invention's performance of the "hands free" light directing function, compressed air from train's brake line 27 continuously powers and actuates the light 17, effectively eliminating any risk of a battery failure or battery depletion induced malfunction of the light. Accordingly, the instant invention operates to reduce risks of falling injuries to the lookout operator and to reduce risks of train car collisions upon backing.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. A railcar shove light assembly comprising:

(a) a turbine;

(b) a first case having at least a first air input port and having at least a first air output port, the turbine being rotatably mounted within the first case;

(c) an electrical alternator, the electrical alternator being capable of producing an electrical current output;

(d) a rotary drive linkage operatively interconnecting the turbine and the electrical alternator;

(e) electrical illuminating means;

(f) a network of electrically conductive wires electrically interconnecting the electrical illuminating means and the electrical alternator;

(g) a second case having a rearward end, the second case housing the first case, the turbine, the electrical alternator, the rotary drive linkage, the electrical illuminating means, and the network of electrically conductive wires;

(h) mounting means supporting the electrical illuminating means upon the second case, mounting means positioning the electrical illuminating means for rearward illumination;

(i) a compressed air conduit communicating with the first case's at least first air input port;

(j) a railcar rear coupler having a flag post socket;

(k) a support post having upper and lower ends, the second case being fixedly attached to the support post's upper end; and (l) a pin fixedly attached to or formed wholly with the support post's lower end, the pin being nestingly received within the railcar rear coupler's flag post socket.

2. The railcar shove light assembly of claim 1 wherein the railcar rear coupler has a lateral land, and further comprising a rotation stopping flange fixedly attached to the support post, the rotation stopping flange being positioned for engaging the railcar rear coupler's lateral land.

3. The railcar shove light assembly of claim 2 wherein the compressed air conduit comprises an air hose and railcar brake line coupler combination.

4. The railcar shove light assembly of claim 3 wherein the electrical illuminating means comprise a plurality of light emitting diodes.

5. The railcar shove light assembly of claim 4 wherein the electrical illuminating means comprise a reflector array, each reflector among the reflector array being positioned operatively about one of the light emitting diodes.

6. The railcar shove light assembly of claim 5 wherein the electrical illuminating means further comprise a light port rearwardly opening the second case.

7. The railcar shove light assembly of claim 6 further comprising a transparent sheet, the transparent sheet covering the light port.

8. The railcar shove light assembly of claim 7 further comprising an array of light focusing lenses, said array being operatively positioned between the transparent sheet and the reflector array.

9. The railcar shove light assembly of claim 8 wherein the network of electrically conductive wires incorporates an alternating current to direct current electrical rectifier.

10. The railcar shove light assembly of claim 9 further comprising handle means connected operatively to the light case.

* * * * *